US011727854B2

(12) United States Patent
Hu

(10) Patent No.: US 11,727,854 B2
(45) Date of Patent: Aug. 15, 2023

(54) DRIVING CIRCUIT, DISPLAY PANEL, DISPLAY APPARATUS AND VOLTAGE STABILIZATION CONTROL METHOD

(71) Applicant: Xiamen Tianma Display Technology Co., Ltd., Xiamen (CN)

(72) Inventor: Cheng Hu, Xiamen (CN)

(73) Assignee: XIAMEN TIANMA DISPLAY TECHNOLOGY CO., LTD., Xiamen (CN)

( * ) Notice: Subject to any disclaimer, the term of this patent is extended or adjusted under 35 U.S.C. 154(b) by 0 days.

(21) Appl. No.: 17/853,964

(22) Filed: Jun. 30, 2022

(65) Prior Publication Data

US 2023/0215329 A1 Jul. 6, 2023

(30) Foreign Application Priority Data

Dec. 30, 2021 (CN) ..... 202111668586.5

(51) Int. Cl.
*G09G 3/3266* (2016.01)
*G09G 3/20* (2006.01)

(52) U.S. Cl.
CPC ... *G09G 3/2092* (2013.01); *G09G 2310/0267* (2013.01); *G09G 2310/08* (2013.01)

(58) Field of Classification Search
CPC ..... G09G 3/2092; G09G 2310/0267; G09G 2310/08
See application file for complete search history.

(56) References Cited

U.S. PATENT DOCUMENTS

| | | | | |
|---|---|---|---|---|
| 11,217,162 | B2 * | 1/2022 | Han | G09G 3/3233 |
| 11,263,972 | B2 * | 3/2022 | Wu | G09G 3/3258 |
| 11,475,826 | B2 * | 10/2022 | Li | G09G 3/3266 |
| 2016/0012774 | A1 * | 1/2016 | Ohara | G09G 3/3266 345/694 |

(Continued)

FOREIGN PATENT DOCUMENTS

| | | | |
|---|---|---|---|
| CN | 104376826 | A | 2/2015 |
| CN | 107103870 | A | 8/2017 |

(Continued)

OTHER PUBLICATIONS

The First Office Action forChinese Application No. 202111668586.5, dated Nov. 10, 2022, 10 pages.

*Primary Examiner* — Jose R Soto Lopez
(74) *Attorney, Agent, or Firm* — East IP P.C.

(57) ABSTRACT

The embodiments of the application discloses a driving circuit, a display panel, a display apparatus and a voltage stabilization control method. The driving circuit includes an input module, a control module, an output module and a voltage stabilization module. The output module is used to output a scan signal via the output module according to level states of signals at first and second nodes. With respect to the voltage stabilization module, an input terminal thereof is connected to the output terminal of the output module, a first control terminal thereof receives a second clock signal, a second control terminal thereof is connected to the second node, an output terminal thereof is connected to the first node, and the voltage stabilization module is to connect the output terminal of the output module to the first node, when the scan signal is to control a data writing transistor to be turned off.

12 Claims, 6 Drawing Sheets

(56) References Cited

U.S. PATENT DOCUMENTS

| | | | | |
|---|---|---|---|---|
| 2016/0329015 | A1* | 11/2016 | Ji | G09G 3/32 |
| 2017/0193943 | A1* | 7/2017 | Cao | H01L 27/1222 |
| 2017/0256224 | A1* | 9/2017 | Xiao | G09G 3/3677 |
| 2018/0144811 | A1* | 5/2018 | Han | G11C 19/287 |
| 2018/0374410 | A1 | 12/2018 | Zhu et al. | |
| 2019/0348004 | A1* | 11/2019 | Kawashima | G09G 3/36 |
| 2020/0013473 | A1* | 1/2020 | Xuan | G09G 3/20 |

FOREIGN PATENT DOCUMENTS

| | | | |
|---|---|---|---|
| CN | 111816127 | A | 10/2020 |
| CN | 111833820 | A | 10/2020 |
| WO | 2016119342 | A1 | 8/2016 |

* cited by examiner

DRIVING CIRCUIT, DISPLAY PANEL, DISPLAY APPARATUS AND VOLTAGE STABILIZATION CONTROL METHOD

CROSS REFERENCE TO RELATED APPLICATION

This application claims priority to Chinese Patent Application No. 202111668586.5, filed on Dec. 30, 2021, which is hereby incorporated by reference in its entirety.

TECHNICAL FIELD

The present application relates to the field of display technology, and particularly to a driving circuit, a display panel, a display apparatus and a voltage stabilization control method.

BACKGROUND

AMOLED (Active-Matrix Organic Light-Emitting Diode) panel is known as the panel of next-generation display technology. Its colorization is realized by forming respective pixel unit by sub-pixels with red, green and blue materials, and by combining pixel units to form pixel arrangement structures. The display effects of the pixel arrangement structures or the sub-pixels are controlled by a driving circuit(s). Therefore, the performance of the driving circuit may directly affect the display effect of the display panel.

In order to ensure a stable output of the driving circuit, a voltage stabilization circuit is provided therein. However, there is a problem that the traditional voltage stabilization circuit has a high possibility to fail, which causes the output waveform of the driving circuit unstable, which in turn results in a poor performance of the driving circuit.

SUMMARY

The embodiments of the present application provide a driving circuit, a display panel, a display apparatus and a voltage stabilization control method.

An aspect of the present application provides a driving circuit comprising: an input module, wherein a first input terminal of the input module receives an input signal, a second input terminal of the input module receives a first constant voltage signal, a control terminal of the input module receives a first clock signal, and the input module is used to input the input signal to a first node and input the first constant voltage signal to a second node when the first clock signal is at a valid level; a control module, wherein an input terminal of the control module receives the first clock signal, a control terminal of the control module is connected to the first node, an output terminal of the control module is connected to the second node, and control module is used to input the first clock signal to the second node when the first node is at a valid level; an output module, wherein a first control terminal of the output module is connected to the first node, a second control terminal of the output module is connected to the second node, an output terminal of the output module is connected to a scan line, and the output module is used to output a scan signal via the output terminal of the output module according to a level state of signal at the first node and a level state of signal at the second node; and a voltage stabilization module, wherein an input terminal of the voltage stabilization module is connected to the output terminal of the output module, a first control terminal of the voltage stabilization module receives a second clock signal, a second control terminal of the voltage stabilization module is connected to the second node, an output terminal of the voltage stabilization module is connected to the first node, and the voltage stabilization module is used to connect the output terminal of the output module to the first node, when the scan signal is to control a data writing transistor in a pixel circuit to be turned off, to stabilize outputting of the scan signal.

Another aspect of the present application further provides a display panel including the driving circuit of the above aspect.

Yet another aspect of the present application further provides a display apparatus including the display panel of the above aspect.

Yet another aspect of the present application further provides a display apparatus including the driving circuit of the above aspect.

Further another aspect of the present application further provides a voltage stabilization control method used by the driving circuit of the above aspect, comprising: providing, by the voltage stabilization module, a voltage stabilization signal to the first node when the second node is at a valid level and the second clock signal is at a valid level, wherein the voltage stabilization signal is the scan signal.

BRIEF DESCRIPTION OF THE DRAWINGS

In order to illustrate technical solutions of embodiments of the present application more clearly, the drawings required for the embodiments of the present application will be briefly described. Obviously, the drawings described below are only some embodiments of the present application. For a person skilled in the art, other drawings can also be obtained from these drawings without any inventive effort.

In the drawings.

Figure 1:
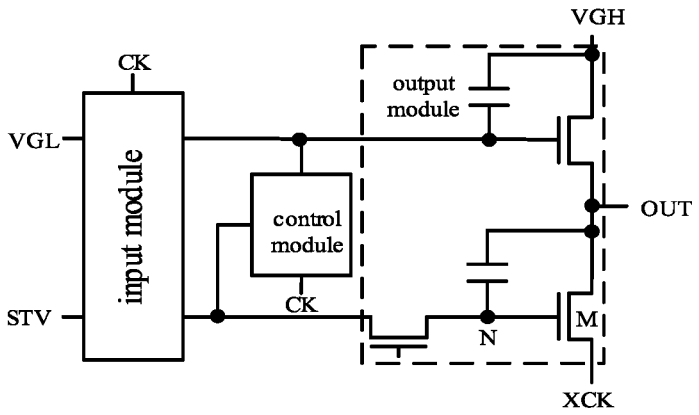
FIG. 1 is a schematic structural diagram of a circuit module of a driving circuit in the prior art.

L. light-emitting element; 30. pixel circuit; 31. driving module; TO. driving transistor; 32. light-emitting control module; 34. data writing module; 35. compensation module; 36. reset module; 37. initialization module; T1-T7. first to seventh transistors; EM. light-emitting control signal; S1-S4. first to fourth scan signals; Vref. reset signal; Data. data signal; Vini. initialization signal; 41. input module; 42. control module; 43. output module; 44. voltage stabilization module; 431. first output unit; 432. second output unit; CK. first clock signal; XCK. second clock signal; VGL. first constant voltage signal; VHG. second constant voltage signal; STV. input signal; N1. first node; N2. second node; N4. fourth node; M1-M8. first to eighth switch transistors; C1. first capacitor; C2. second capacitor; OUT. output terminal of the driving circuit; 200. display apparatus.

DETAILED DESCRIPTION

The embodiments of the technical solutions of the present application will be described in detail below with reference to the accompanying drawings. The following embodiments are only used to illustrate the technical solutions of the present application more clearly, and are therefore only used as examples, and are not used to limit the protection scope of the present application.

It should be noted that the embodiments in the present application and the features of the embodiments may be combined with each other unless they are conflict with each other.

Unless otherwise defined, all technical and scientific terms used herein have the same meaning as commonly understood by ordinary person skilled in the art of this application; the terms used herein are for the purpose of describing specific embodiments only, and are not intended to limit this application; the terms "comprise" and "have" and any variations thereof in the description and claims together with the drawings of this application are intended to indicate non-exclusive inclusion.

In the description of the embodiments of the present application, the technical terms "first", "second" and so on are only used to distinguish different objects, and should not be understood as indicating or implying relative importance or implying the number, specific sequence or primary/secondary relationship of the technical features. In the description of the embodiments of the present application, "a plurality of" means two or more, unless it is expressly specifically limited otherwise.

The term "embodiment" referred herein means that particular features, structures, or characteristics described in connection with the embodiment may be included in at least one embodiment of the present application. The appearances of this term in various places in the description are not necessarily all referring to the same embodiment, nor a separate or alternative embodiment that is mutually exclusive with other embodiments. It is explicitly and implicitly understood by a person skilled in the art that the embodiments described herein may be combined with other embodiments.

In the description of the embodiments of the present application, the term "plurality" means to two or more (including two), similarly, "multiple groups" means more than two groups (including two groups), and "multiple pieces" means two or more pieces (including two pieces).

In the technical field of OLED display panels, generally, a light-emitting control signal shift register and a gate scan signal shift register are used to control the outputs of light-emitting control signal and scan signal, respectively. The main portion of the gate scan signal shift register is a driving circuit similar to that provided in FIG. 1.

Referring to FIG. 1, the driving circuit usually includes an input module, a control module and an output module, wherein the output module may be a 3T2C circuit structure, and the output terminal of the output module is served as the output terminal OUT of the driving circuit, which may be connected to a scan line (not shown), and then provide scan signal to the scan line, to turn on/off a data writing transistor(s) correspondingly connected to the scan line.

It should be noted that the driving circuit shown in FIG. 1 realizes its signal control mainly based on the shift output of the clock signal CK. Although this designed circuit structure may control the output of the scan signal, to turn on the correspondingly connected data writing transistor(s) in the pixel circuit(s), its output waveform is not stable enough, which may cause the data writing transistor cannot be normally turned off To this end, in the prior art, based on the structure shown in FIG. 1, a voltage stabilization structure (not shown) may further be provided to stabilize the output waveform of the scan signal when the scan signal is to control the data writing transistor(s) to be turned off. However, the inventor of the present application found that, if the voltage stabilization structure is arranged, and the scan signal output from the output terminal OUT of the driving circuit is to control the data writing transistor(s) to be turned off, the output waveform of scan signal may still be un-stabile due to that the voltage stabilization circuit has a high possibility to fail, in the prior art.

Figure 2:
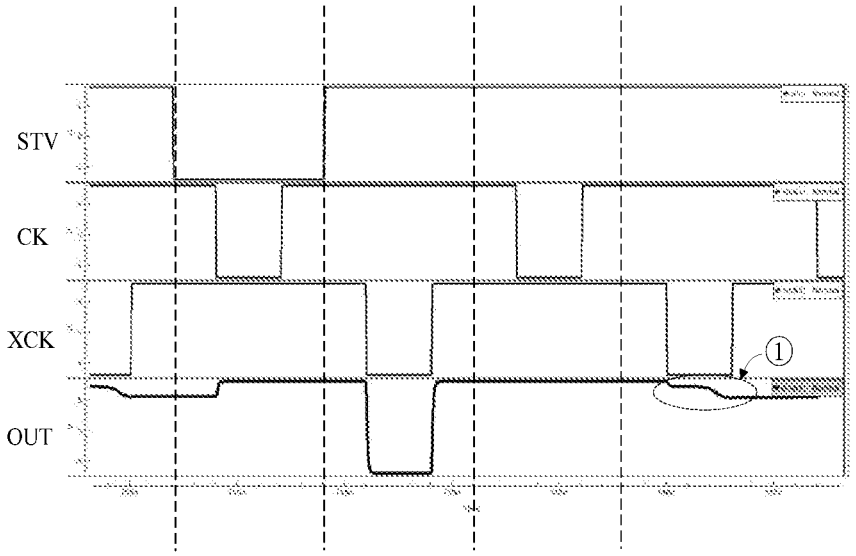
FIG. 2 is a simulated timing diagram of respective signals in a driving circuit provided with a voltage stabilization structure in the prior art.

Please refer to FIG. 2. FIG. 2 shows a simulated timing diagram of respective signals in a driving circuit provided with a voltage stabilization structure in the prior art.

Please refer to the structural diagram of the output module in FIG. 1 together with FIG. 2. When the output terminal OUT of the driving circuit is at a high potential and the clock signal XCK is at a low potential, the node N will be coupled downward, resulting in that the potential of the N node is insufficient to completely turn off the transistor M connected to the N node, which causes the scan signal output by the output terminal OUT of the driving circuit to be pulled down (i.e., the position ① in FIG. 2). To sum up, in the prior art, the arranging of the voltage stabilization structure may result in the output waveform of the driving circuit unstable, that is, there is a problem that the performance of the driving circuit is not good.

In order to solve this technical problem, an embodiment of the present application provides a driving circuit, which can be connected to a scan line in a display panel, and the driving circuit may provide a scan signal, which may be used to control the turn-on and turn-off of the data writing transistor in the pixel circuit.

Figure 3:
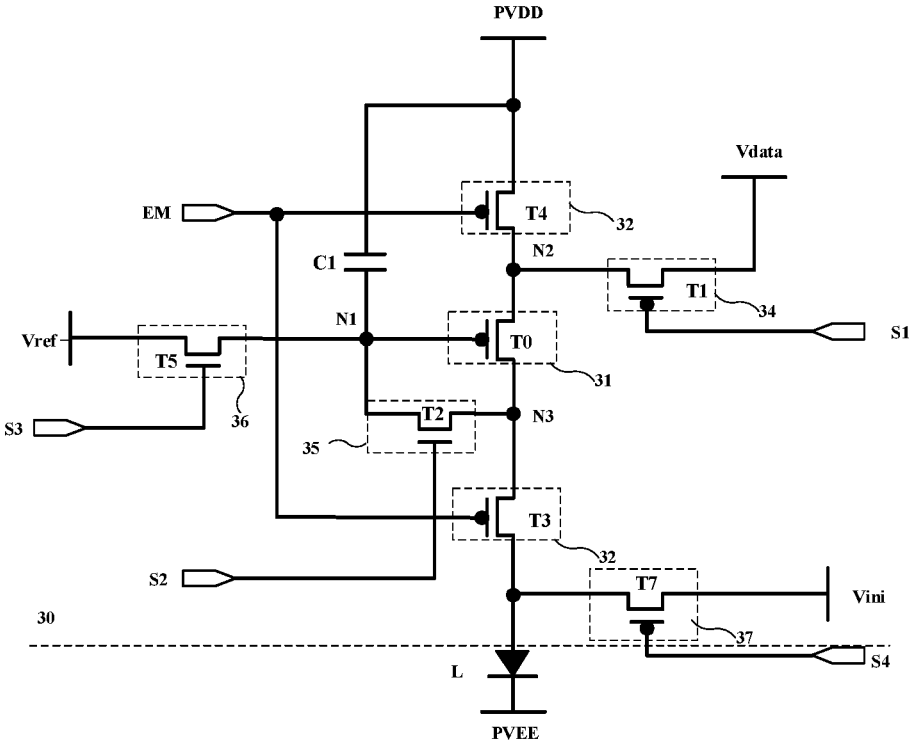
FIG. 3 is a schematic circuit structure diagram of a pixel circuit related to the embodiments of the present application.

In order to better illustrate the function of the driving circuit provided by the present application, referring to FIG. 3, the following will briefly describe a pixel circuit, which may be controlled by the scan signal transmitted by the driving circuit. The pixel circuit 30 includes a driving module 31 including a driving transistor TO, and the pixel circuit 30 may further include a light-emitting control module 32, a data writing module 34, a compensation module 35, a reset module 36 and an initialization module 37.

The light-emitting control module 32 may be used to selectively allow the light-emitting element L to enter into a light-emitting stage; and the light-emitting control module 32 may include a third transistor T3 and a fourth transistor T4. The control terminals of the third transistor T3 and the fourth transistor T4 are connected to a light-emitting control signal line (not shown) for receiving a light-emitting control signal EM.

When the light-emitting control signal line outputs a valid pulse (i.e., the light-emitting control signal EM), the third transistor T3 and the fourth transistor T4 are turned on, and the light-emitting element L is driven to enter into the light-emitting stage, while the driving current flows into the light-emitting element L. When the light-emitting control signal line outputs an invalid pulse, the third transistor T3 and the fourth transistor T4 are turned off, and a path, through which the driving current flows into the light-emitting element L, is cut off.

The data writing module 34 may be used to selectively provide the data signal Vdata to the driving transistor T0; the data writing module 34 may include a first transistor T1, which is a data writing transistor. A drain of the first transistor T1 may be connected to a source of the driving transistor T0, a source of the first transistor T1 may be connected to the data signal line and may receive the data signal Vdata, a control terminal of the first transistor T1 may be connected to a first scan signal line and may be used to receive a first scan signal S1, and the first scan signal S1 may be used to control the turn-on and turn-off of the first transistor T1. The first scan signal is transmitted from the output terminal of the driving circuit.

The compensation module 35 may be connected between the gate of the driving transistor T0 and a drain of the driving transistor T0, and the compensation module 35 may be used to compensate a threshold voltage of the driving transistor T0. The compensation module 35 may include a second transistor T2, a control terminal of the second transistor T2 is connected to a second scan signal line and may receive a second scan signal S2, and the second scan signal S2 may be used to control the turn-on or turn-off of the second transistor T2.

The reset module 36 may be connected between a reset signal terminal and the gate of the driving transistor T0, and the reset module 36 may be used to provide a reset signal Vref to the gate of the driving transistor T0. The reset module 36 may include a fifth transistor T5, a source of the fifth transistor T5 may be connected to the reset signal terminal and may be used to receive the reset signal Vref, and a gate of the fifth transistor T5 may be connected to a third scan signal line and may be used to receive a third scan signal S3.

The initialization module 37 may be connected between an initialization signal terminal and the light-emitting element L, and may be used to selectively provide an initialization signal Vini to the light-emitting element L. A control terminal of the initialization module 37 may be connected to a fourth scan signal line and used to receive a fourth scan signal S4.

Optionally, the initialization module 37 may include a seventh transistor T7, a source of the seventh transistor T7 is connected to the initialization signal terminal, a drain of the seventh transistor T7 is connected to the light-emitting element L, and a gate of the seventh transistor T7 is connected to a fourth scan signal line. When the initialization module 37 is turned on, the pixel circuit 30 enters into an initialization stage.

It can be understood that, based on the optional circuit structure of the pixel circuit 30 shown in FIG. 3, in order to enable the pixel circuit 30 to provide the driving current to the light-emitting element L in an orderly manner, a driving circuit is needed to be arranged in the display panel.

Figure 4:
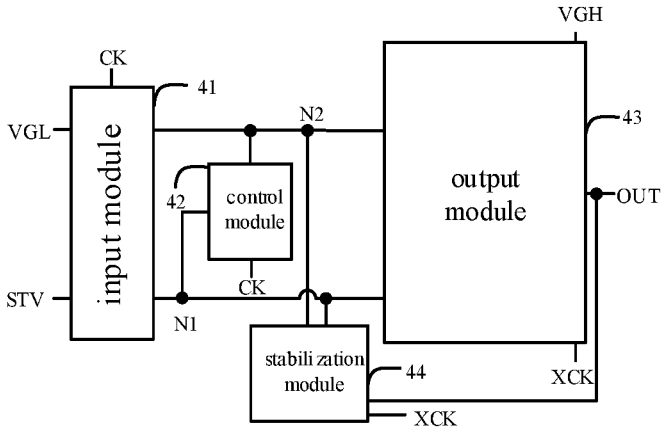
FIG. 4 is a schematic module structure diagram of an embodiment of a driving circuit according to an embodiment of the present application.
Figure 5:
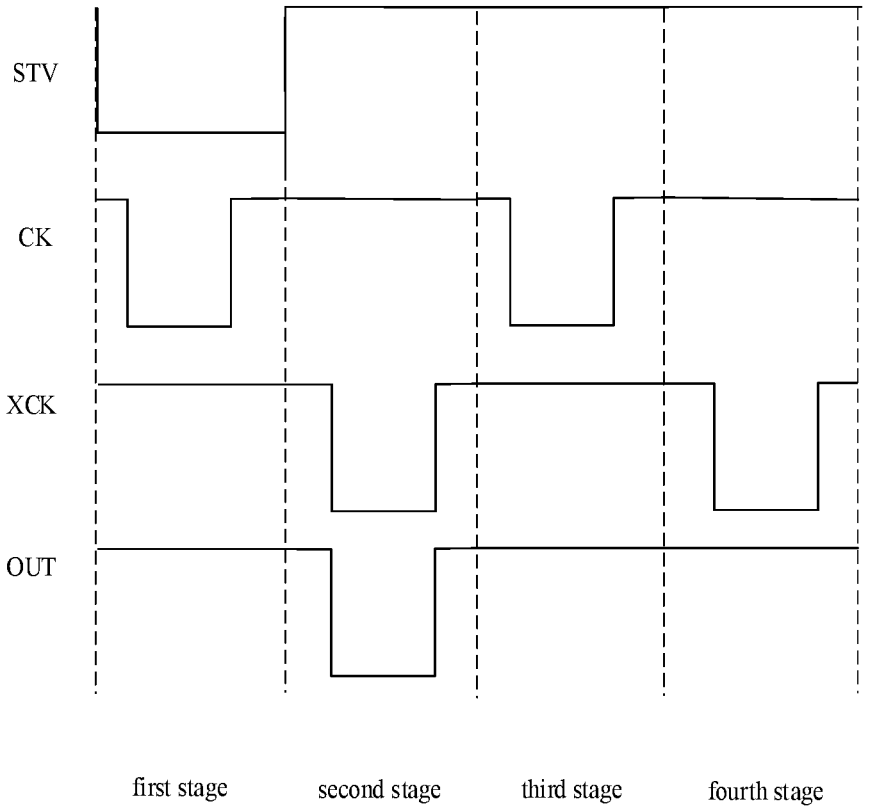
FIG. 5 is an ideal timing diagram of respective signals in the driving circuit of FIG. 4.

Please refer to FIG. 4 together with and FIG. 5, wherein FIG. 4 is schematic structure diagram of an optional embodiment of a driving circuit according to the present application. In FIG. 4, VGL is a first constant voltage signal, which may be a constant voltage low level signal; VGH is a second constant voltage signal, which has a level opposite to that of the first constant voltage signal, and may be a constant voltage high level signal. FIG. 5 is an ideal timing diagram of an optional embodiment of respective signals in the driving circuit of FIG. 4.

It should also be noted that the timing diagram shown in FIG. 5 shows a driving cycle for the driving circuit with a low level as a valid level, wherein a level state of the first clock signal CK is opposite to the corresponding level state of the second clock signal XCK, STV is the input signal, and OUT is the output terminal of the driving circuit, and the following descriptions will be given based on these.

In FIG. 4, the driving circuit may include an input module 41, a control module 42, an output module 43 and a voltage stabilization module 44.

A first input terminal of the input module 41 may receive the input signal STV, a second input terminal of the input module 41 receives a first constant voltage signal VGL, a control terminal of the input module 41 may receive the first clock signal CK.

The input module 41 may be used to input the input signal STV to a first node N1 and input the first constant voltage signal VGL to a second node N2, when the first clock signal CK is at a valid level.

An input terminal of the control module 42 may receive the first clock signal CK, a control terminal of the control module 42 is connected to the first node N1, an output terminal of the control module 42 is connected to the second node N2.

The control module 42 may be used to input the first clock signal CK to the second node N2, when the first clock signal CK is at a valid level.

A first control terminal of the output module 43 is connected to the first node N1, a second control terminal of the output module 43 is connected to the second node N2, an output terminal of the output module 43 is connected to a scan line. The output module 43 may be used to output a scan signal via the output terminal of the output module 43, according to level state of signal at the first node N1 and level state of signal at the second node N2.

An input terminal of the voltage stabilization module 44 is connected to the output terminal of the output module 43, a first control terminal of the voltage stabilization module 44 receives a second clock signal XCK, a second control terminal of the voltage stabilization module 44 is connected to the second node N2, an output terminal of the voltage stabilization module 44 is connected to the first node N1.

The voltage stabilization module 44 may be used to connect the output terminal of the output module 43 to the first node N1, when the scan signal is to control the data writing transistor in the pixel circuit to be turned off, to stabilize the outputting of the scan signal.

In the embodiment of the present application, the voltage stabilization module 44 may be used to stabilize the waveform output by the output terminal of the output module 43, wherein when the scan signal is to control the data writing transistor to be turned off, the voltage stabilization module 44 is turned on, such that the input terminal of the voltage stabilization module 44 is controlled to be connected with the output terminal thereof. Further, the input terminal of the voltage stabilization module 44 is connected to the output terminal of the output module 43, and the output terminal of the voltage stabilization module 44 is connected to the first node N1, and thus when the scan signal is to control the data writing transistor to be turned off, the output terminal of the output module 43 is connected with the first node N1.

In addition, the output terminal of the output module 43 is used to output the scan signal, the scan signal is generated according to the level state of signal at the first node N1 and the level state of signal at the second node N2, and in turn the level state of signal at the first node N1 and level state of signal at the second node N2 are controlled by the shifts of the clock signals in the input module 41 and the control module 42. Thus, the scan signal is varied dynamically in a driving cycle, such that the input terminal of the voltage stabilization module 44 may be dynamically reset before the fourth stage of the driving cycle is arrived, which may enable that when the fourth stage of the driving cycle arrives, that is, when the second clock signal XCK is at a low potential and the output terminal OUT of the driving circuit is at a high potential, the voltage stabilization module 44 is efficient. Thus, compared to the prior art, the downward coupling influence by the second clock signal XCK may be reduced, the output module 43 may be operated normally, and finally the pulling down on the output scan signal may be avoided, and the stability of the signal output by the output terminal of the driving circuit may be enabled.

Figure 6:
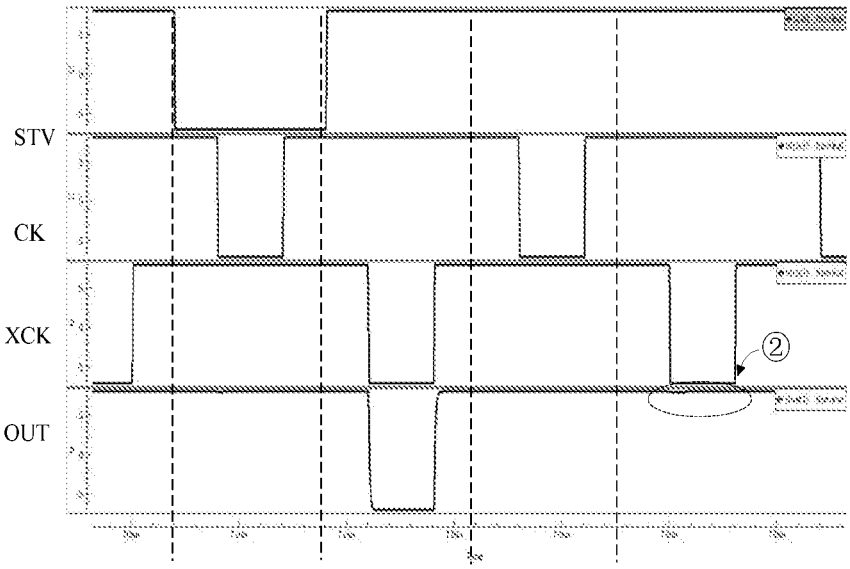
FIG. 6 is a simulated timing diagram of respective signals in the driving circuit of FIG. 4.

In order to illustrate the beneficial effects brought about by the difference between the technical solutions of the embodiments of the present application and the prior art, please refer to FIG. 6, wherein FIG. 6 is a simulated timing diagram of respective signals in the driving circuit, when the driving circuit is controlled according to the ideal timing shown in FIG. 5. As shown in FIG. 6, compared to the prior art, the output waveform in the fourth stage of the drive cycle is stable (i.e., position ② in FIG. 6), and thus the control signal output to the data writing transistor will be stable, and the data write transistor will be turned off normally.

That is, compared to the prior art, the embodiment of the present application may reduce the possibility of failure of the voltage stabilization module circuit, and thus the problem that the voltage stabilization circuit is prone to fail and degradation of the performance of the driving circuit in the prior, may be improved.

Figure 7:
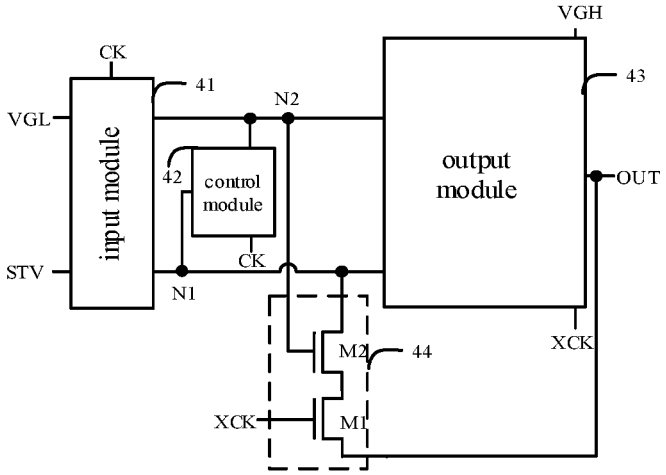
FIG. 7 is a schematic circuit structure diagram of another embodiment of a driving circuit according to the present application.
Figure 8:
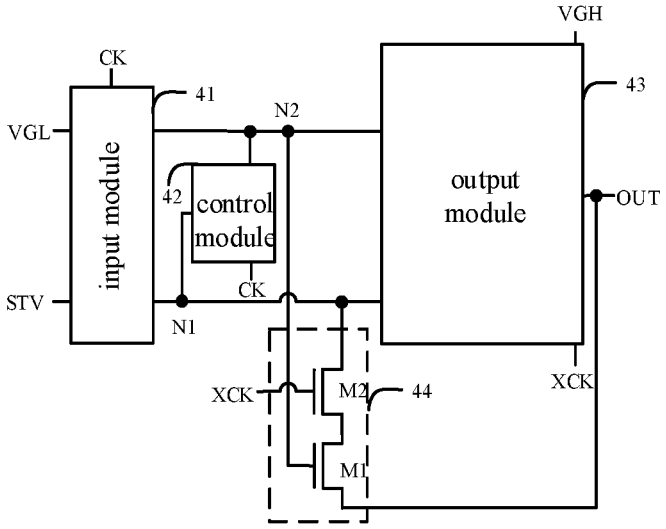
FIG. 8 is a schematic circuit structure diagram of yet another embodiment of a driving circuit according to the present application.

Please refer to FIG. 7 and FIG. 8, and together with FIG. 4 and FIG. 5, wherein FIG. 7 and FIG. 8 are schematic circuit structure diagrams of another two embodiments of the driving circuit according to the present application. In the embodiments shown in FIGS. 7 and 8, the above described optional structure of the voltage stabilization module 44 is provided.

In FIG. 7, the voltage stabilization module 44 may include a first switch transistor M1 and a second switch transistor M2. A control electrode of the first switch transistor Ml is the first control terminal of the voltage stabilization module 44, a first electrode of the first switch transistor M1 is the input terminal of the voltage stabilization module 44, and a second electrode of the first switch transistor M1 is connected to a first electrode of the second switch transistor M2. A control electrode of the second switch transistor M2 is the second control terminal of the voltage stabilization module 44, and a second electrode of the second switch transistor M2 is the output terminal of the voltage stabilization module 44.

Alternatively, please refer to FIG. 8, the voltage stabilization module 44 in FIG. 8 may also include a first switch M1 and a second switch M2. A control electrode of the first switch transistor M1 is the second control terminal of the voltage stabilization module 44, a first electrode of the first switch transistor M1 is the input terminal of the voltage stabilization module 44, and a second electrode of the first switch transistor M1 is connected to a first electrode of the second switch transistor M2. A control electrode of the second switch transistor M2 is the first control terminal of the voltage stabilization module 44, and a second electrode of the second switch transistor M2 is the output terminal of the voltage stabilization module 44.

It should be noted that, the first switch transistor M1 and the second switch transistor M2 in the voltage stabilization module 44 may be thin film transistors, for example, P-type thin film transistors. The control electrodes of the first switch transistor M1 and the second switch transistor M2 are gates thereof. The first electrodes of the first switch transistor M1 and the second switch transistor M2 may be drains thereof, and the second electrodes of the first switch transistor M1 and the second switch transistor M2 are the sources thereof, and vice versa.

In the fourth stage of the driving cycle of the driving circuit, the first clock signal CK and the input signal STV are both at high level (inactive level), and the level state of the second clock signal XCK is opposite to the level state of the first clock signal CK, that is, the second clock signal XCK at a low level (active level) at this stage, meanwhile the output terminal of the output module 43 (i.e., the output terminal OUT of the driving circuit) outputs a high level signal, so that the data writing transistor is turned off. At this time, the voltage stabilization module 44 is turned on, which may connect the output terminal of the output module 43 to the first node N1, so that the first switch M1 and the second switch M2 are both turned on. Thus, the effectiveness of the voltage stabilization module 44 may be enabled by using the scan signal, the downward coupling influence for the output module 43 by the second clock signal XCK may be reduced, the output module 43 may be operated normally, and the output waveform of the signal output by the output module 43 may be stabilized. Thus, when the scan signal is output to the data writing transistor, the data writing transistor can be turned off normally, which may enable that the displaying of the display panel is normal.

Figure 9:
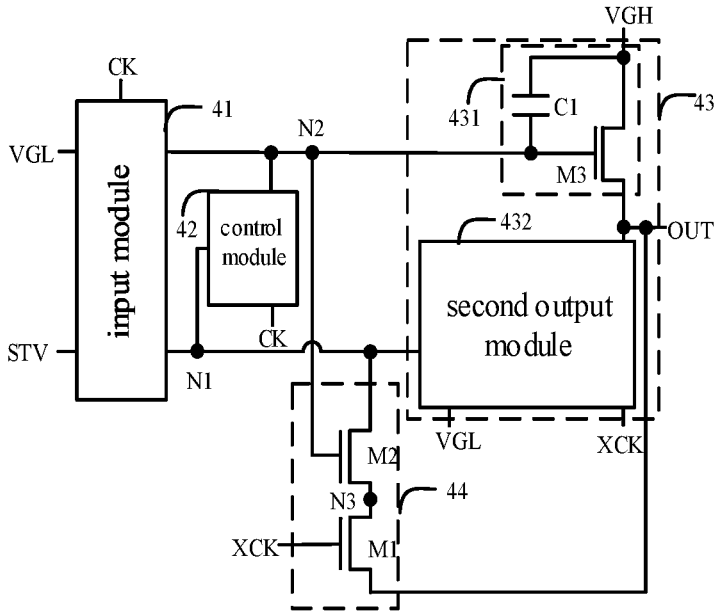
FIG. 9 is a schematic circuit structure diagram of yet another embodiment of a driving circuit according to the present application.

Please refer to FIG. 9 together with FIG. 5, wherein FIG. 9 shows an optional schematic structure diagram of yet another embodiment of a driving circuit according to the present application. In this embodiment, an optional structure of the output module 43 is provided.

The output module 43 may include a first output unit 431. An input terminal of the first output unit 431 receives a second constant voltage signal VGH, an control terminal of the first output unit 431 is the second control terminal of the output module 43, an output terminal of the first output unit 431 is connected to an output terminal node, and the output terminal node is the output terminal of the output module 43, and is the output terminal OUT of the driving circuit.

The first output unit 431 may be used to output the second constant voltage signal VGH when the second node N2 is at a valid level. The second constant voltage signal VGH has a same signal state as the first scan signal included in the scan signal, and the first scan signal may be used to control the data writing transistor to be turned off.

The first output unit 431 may include a third switch transistor M3 and a first capacitor C1.

A control electrode of the third switch transistor M3 is the control terminal of the first output unit 431, a first electrode of the third switch transistor M3 is the input terminal of the first output unit 431, and a second electrode of the third switch transistor M3 is the output terminal of the first output unit 431. The third switch transistor M3 may be a transistor, for example, thin film transistor of P-type.

A first terminal of the first capacitor C1 is connected to the control electrode of the third switch transistor M3, and a second terminal of the first capacitor C1 is connected to the first electrode of the third switch transistor M3.

The above mentioned first scan signal corresponds to a high level signal output by the output terminal OUT of the driving circuit in the fourth stage shown in FIG. 5, and in this stage, each of the input signal STV and the first clock signal CK is at a high level (i.e., an invalid level), and the second clock signal XCK is at a low level (i.e., an valid level). Thus, in this stage, the first output unit 431 outputs the second constant voltage signal VGH, that is, the first output unit 431 is turned on, and the second constant voltage signal VGH is communicated to the second electrode of the third switch M3.

The following will describe the principle that the first output unit 431 could be turned on in the fourth stage. Due to the stored energy of the first capacitor C1 in a previous stage (i.e., the third stage), in the fourth stage, the second node N2 is in a low level valid state, and the third switch transistor M3 maintains a turn-on state. Thus, the first output unit 431 is turned on, and the second constant voltage signal VGH of high level may be output from the output terminal of the first output unit 431. Thus, the output terminal of the output module 43 outputs the first scan signal of high level, wherein the first scan signal is used to control the data writing transistor to be turned off.

It should be noted that, in the third stage, the input signal STV maintains a high level and the first clock signal CK is a valid low level signal. In this stage, the input module 41 is turned on and the control module 42 is turned off. Further, the input module 41 inputs the first constant voltage signal VGL of low level to the second node N2, and thus the second node N2 maintains a valid level.

Figure 10:
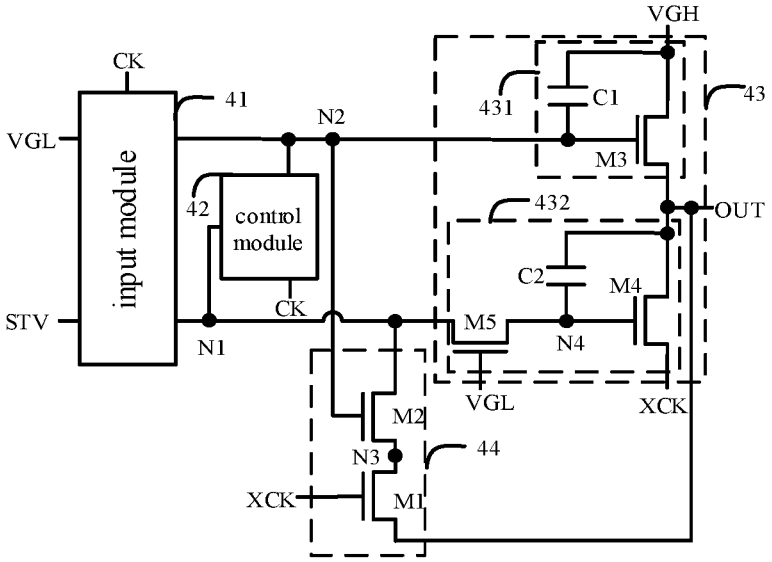
FIG. 10 is a schematic circuit structure diagram of yet another embodiment of a driving circuit according to the present application.

Referring to FIG. 5, FIG. 9 and FIG. 10, the above mentioned output module 43 may further include a second output unit 432, wherein FIG. 10 shows an optional structure of the second output unit 432 in the driving circuit according to the present application. An input terminal of the second output unit 432 receives the second clock signal XCK, a control terminal of the second output unit 432 is the first control terminal of the output module 43, and an output terminal of the second output unit 432 is connected to the output terminal node.

The second output unit may be used to output the second clock signal XCK when the second node N2 is at an invalid level and the first node N1 is at a valid level, wherein the second clock signal XCK has a signal state corresponding to that of a second scan signal included in the scan signal, and second scan signal may be used to control the data writing transistor to be turned on.

The second output unit 432 may include a fourth switch transistor M4, a fifth switch transistor M5 and a second capacitor C2.

A first electrode of the fourth switch transistor M4 is the output terminal of the second output unit 432, and a second electrode of the fourth switch transistor M4 is the input terminal of the second output unit 432.

A first electrode of the fifth switch transistor M5 is connected to a control electrode of the fourth switch transistor M4, a control electrode of the fifth switch transistor M5 receives the first constant voltage signal VGL, and a second electrode of the fifth switch transistor M5 is the control terminal of the second output unit 432.

A first terminal of the second capacitor C2 is connected to the control electrode of the fourth switch transistor M4, and a second terminal of the second capacitor C2 is connected to the first electrode of the fourth switch transistor M4.

The above mentioned second scan signal corresponds to a second stage in the driving cycle of the driving circuit. In this stage, each of the input signal STV and the first clock signal CK is at a high level (i.e., invalid level), and the second clock signal XCK is at a low level (i.e., valid level). In this stage, the second output unit 432 outputs the second clock signal XCK, that is, the second output unit 432 is turned on, and the second clock signal XCK is communicated to the second electrode of the fourth switch M4.

The following will describe the principle that the second output unit 432 could be turned on in the second stage. Due to the affection of the state of the second capacitor C2 in a previous stage (i.e., the first stage), the fourth node N4 is in a low level valid state, and the fourth switch transistor M4 maintains a turn-on state. Thus, a second clock signal XCK of low level may be output from the output terminal of the second output unit 432. Thus, the output terminal of the output module 43 (i.e., the output terminal OUT of the driving circuit) outputs the second clock signal of low-level, wherein the second scan signal is used to control the data writing transistor to be turned on.

It should be noted that, in the first stage, the input signal STV maintains a low level, and the first clock signal CK is a valid low level signal. At this stage, the input module 41 is turned on, the control module 42 is turned on, each of the first node N1 and the second node N1 receives a low level signal, and the node N4 maintains a valid low level state, wherein he arranging of the second capacitor C2 may enable the valid low level state of the node N4 still to be maintain when the second stage of the driving cycle arrives.

Figure 11:
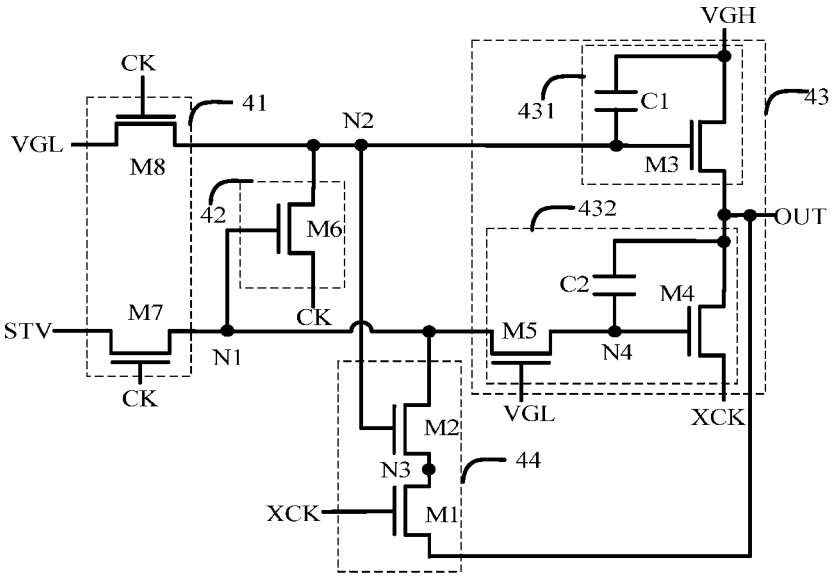
FIG. 11 is a schematic circuit structure diagram of yet another embodiment of a driving circuit according to the present application.

Referring to FIG. 11, FIG. 11 shows a schematic structure diagram of a yet another embodiment of a driving circuit according to the present application. On the basis of the foregoing embodiments, this embodiment further provides optional structures of the control module 42 and the input module 41.

The control module 42 may include a sixth switch M6. A control electrode of the sixth switch transistor M6 is the control terminal of the control module 42, a first electrode of the sixth switch transistor M6 is the input terminal of the control module 42, and a second electrode of the sixth switch transistor M6 is the output terminal of the control module 42.

The input module 41 includes a seventh switch M7 and an eighth switch M8.

A control terminal of the seventh switch transistor M7 receives the first clock signal CK, a first electrode of the seventh switch transistor M7 is the first input terminal of the input module 41, and a second electrode of the seventh switch transistor M7 is connected to the first node N1.

A control terminal of the eighth switch transistor M8 receives the first clock signal CK, a first electrode of the eighth switch transistor M8 is the second input terminal of the input module 41, and a second electrode of the eighth switch transistor M8 is connected to the second node N2.

Each of the sixth switch transistor, the seventh switch transistor and the eighth switch transistor is a thin film transistor, for example, P-type transistor.

The following describes a complete driving cycle implementation process of the driving circuit with reference to FIG. 5 and FIG. 11.

The first stage (reset stage): each of the first clock signal CK and the input signal STV is a valid low level signal, and the second clock signal XCK is a high level signal, that is, an invalid level. In the input module 41, the seventh switch transistor M7 and the eighth switch transistor M8 are turned on under the control of the first clock signal CK, wherein the seventh switch transistor M7 inputs the input signal STV of low level to the first node N1, and this input signal STV enable the first node N1 in an valid level state. At this time, the sixth switch transistor M6 in the control module 42 is turned on, the fifth switch transistor M5 and the fourth switch transistor M4 in the output module 43 are turned on, and the second clock signal XCK is written into the output terminal node through the fourth switch transistor M4, and thus the output terminal node is at a high level.

In addition, under the control of the first clock signal CK, the first constant voltage signal VGL is input to the second node N2 through the input module 41, combined with the first clock signal CK of low level input from the first node N1 through the control module 42, the second node N2 is in a low-level valid state, so that the third switch M3 is turned on, that is, the first output unit 431 is turned on, and the first output unit also outputs a high level signal to the output terminal node. Meanwhile, the second switch transistor M2 in the voltage stabilization module 44 is turned on, and the first switch transistor M1 in the voltage stabilization module 44 is in a turn-off state due to the second clock signal XCK of high level.

The second stage (the output stage of the second scan signal): each of the input signal STV and the first clock signal CK is at an invalid high level, and the second clock signal XCK is at a low level, that is, a valid level. At this time, the input module 41 does not input any signal to the first node N1 and the second node N2. However, the first node N1 maintains the valid low level state of the first stage by means of the second capacitor C2, and thus the fifth switch transistor M5 and the sixth switch transistor M6 maintain their turn-on state at this time. Then, the low level of the second clock signal XCK is output to the output terminal of the output module 43 through the fourth switch M4, that is, the output terminal OUT of the driving circuit outputs a low level signal at this time. Further, the sixth switch M6 is turned on, so that the high level of the first clock signal CK is transmitted from the input terminal of the control module 42 to the output terminal of the control module 42, and the second node N2 receives the high level and is in an invalid level state , and thus the third switch transistor M3 in the output module 43 and the second switch transistor M2 in the voltage stabilization module 44 are turned off, that is, the first output unit 431 is turned off, and the voltage stabilization module 44 is turned off. Finally, the second scan signal output by the output terminal of the output module 43 is the second clock signal XCK of low level output by the fourth switch transistor M4, and the second scan signal may be used to control the data writing transistor to be turned on.

The third stage (reset stage): each of the input signal STV and the second clock signal XCK is at a high level and in an invalid level state, and the first clock signal CK is a low level and in a valid level state. At this time, the seventh switch transistor M7 and the eighth switch transistor M8 in the input module 41 are turned on by the valid level of the first clock signal CK, so that the input signal STV of the high level is transmitted to the first node N1 through the seventh switch transistor M7. Meanwhile, the fourth switch transistor M4 in the second input unit is turned off, and the sixth switch M6 in the control module 42 is turned off In addition, the first constant voltage signal VGL is transmitted to the second node N2 through the eighth switch transistor M8, the second node N2 is in a low level state, the third switch transistor M3 in the first output unit is turned on, and the second constant voltage signal VGH of high level is output through the third switch transistor M3, that is, the output terminal OUT of the driving circuit outputs a high level signal at this time.

The fourth stage (the output stage of the first scan signal): each of the input signal STV and the first clock signal CK is an invalid signal of a high level, and the second clock signal XCK is in a low level state, that is, a valid level. At this time, the first node N1 and the fourth node N4 maintain the high level state in the third stage by means of the second capacitor C2, so the fourth switch transistor M4 in the output module 43 is turned off, and the six switch transistor M6 in the control module 42 is turned off.

By means of the first capacitor C1, the second node N2 maintains the level state in the third stage, that is, the low level state, the third switch transistor M3 is turned on, and the second constant voltage signal VGH of high level is transmitted to the output terminal of the output module 43 through the third switch transistor M3, and finally the output terminal OUT of the driving circuit outputs a high level signal, and this high level signal may be used to control the data writing transistor to be turned off. Meanwhile, the first switch transistor M1 and the second switch transistor M2 in the voltage stabilization module 44 are turned on, and the scan signal output by the output terminal of the output module 43 is served as a voltage stabilization signal, and this voltage stabilization signal flows from the first node N1 to the fourth node N4, to reduce downward coupling impact on the fourth node N4 by the second clock signal XCK, so as to ensure that the second output unit 432 can be normally turned off.

In some embodiments, the driving circuit comprises a plurality of cascaded driving circuits, so that the control for multiple scan lines may be enabled, which provides a structural basis for the gate scan shift register.

The driving circuit of the embodiment of the present application is described in detail above with reference to FIG. 1 to FIG. 11. On this basis, the embodiment of the present application further protects a display panel, and the display panel includes one of the driving circuits provided by the above-mentioned embodiment, and thus the display panel has all the beneficial effects of the above-mentioned driving circuits.

Figure 12:
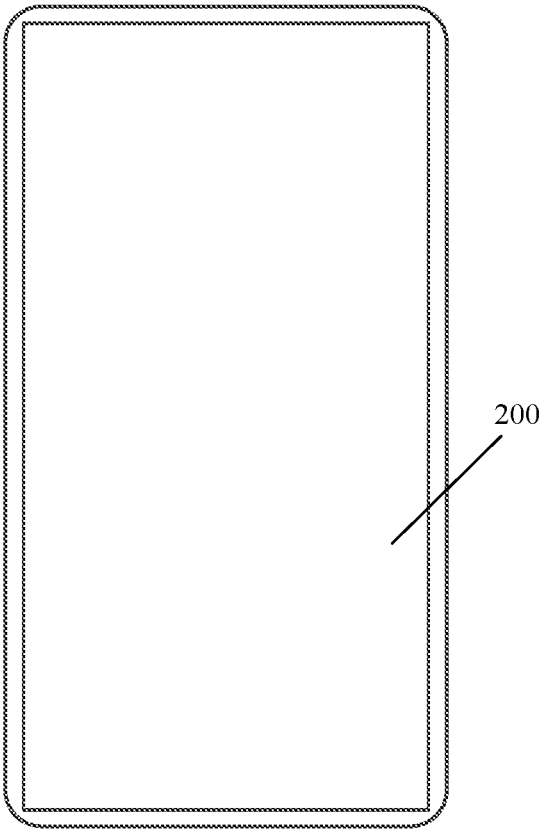
FIG. 12 is a schematic diagram of an embodiment of a display apparatus according the present application.

An embodiment of the present application further provides a display apparatus, please refer to FIG. 12, wherein FIG. 12 is an optional schematic diagram of the display apparatus 200. In addition, the display apparatus 200 may also be one of a wearable apparatus, a camera, a mobile phone, a tablet computer, a display screen, a TV and a vehicle-mounted display terminal. The display apparatus 200 includes the display panel provided in the above-mentioned embodiment, and thus the display apparatus 200 has all the beneficial effects of the above mentioned display panel.

The embodiment of the present application further provides a voltage stabilization control method, and the voltage stabilization control method is applied to the above mentioned driving circuits of FIG. 1 to FIG. 11. The voltage regulation control method includes: providing, by the voltage stabilization module, a voltage stabilization signal to the first node, when the second node is at a valid level and the second clock signal is at a valid level, wherein the voltage stabilization signal is the scan signal.

In the voltage stabilization control method of the present application, when each of the second node and the second clock signal is at valid level, and the voltage stabilization module is turned on, the scan signal is served as the voltage stabilization signal to be provided to the first node, which may reduce the possibility of downward coupling of the second output unit connected to and controlled by the first node. Thus, the effectiveness of the circuit of the voltage stabilization module may be improved, the output module 43 may be operated normally, the final output scan signal being pulled down may be avoided, and stability of the signal output by the output terminal may be enabled.

In addition, the term "and/or" herein only indicates an association relationship for describing associated objects, it indicates that there may be three relationships, for example, A and/or B may indicate three cases including that A exists alone, A and B exist at the same time, and B exists alone. In addition, the character "/" herein generally indicates that the related objects have an "or" relationship.

It should be understood that, in the embodiment of the present application, "B corresponding to A" means that B is associated with A, and B may be determined according to A. However, it should be further understood that determining B according to A does not mean that B is only determined according to A, and B may also be determined according to A and/or other information.

The above description are only specific embodiments of the present application, but the protection scope of the present application is not limited thereto. Any person skilled in the art can easily conceive of various equivalent modifications or substitutions within the technical scope disclosed by the present application. These modifications or substitutions should be within the protection scope of the present application. Therefore, the protection scope of the present application should be subject to the protection scope of the claims.

What is claimed is:

1. A driving circuit, comprising:

an input module, wherein a first input terminal of the input module receives an input signal, a second input terminal of the input module receives a first constant voltage signal, a control terminal of the input module receives a first clock signal, and the input module is used to input the input signal to a first node and input the first constant voltage signal to a second node when the first clock signal is at a valid level;

a control module, wherein an input terminal of the control module receives the first clock signal, a control terminal of the control module is connected to the first node, an output terminal of the control module is connected to the second node, and the control module is used to input the first clock signal to the second node when the first node is at a valid level;

an output module, wherein a first control terminal of the output module is connected to the first node, a second control terminal of the output module is connected to the second node, an output terminal of the output module is connected to a scan line, and the output module is used to output a scan signal via the output terminal of the output module according to a level state of signal at the first node and a level state of signal at the second node; and a voltage stabilization module, wherein an input terminal of the voltage stabilization module is connected to the output terminal of the output module, a first control terminal of the voltage stabilization module receives a second clock signal, a second control terminal of the voltage stabilization module is connected to the second node, an output terminal of the voltage stabilization module is connected to the first node, and the voltage stabilization module is used to connect the output terminal of the output module to the first node, when the scan signal is to control a data writing transistor in a pixel circuit to be turned off, to stabilize outputting of the scan signal, wherein the output module comprises a first output unit; an input terminal of the first output unit receives a second constant voltage signal having an level opposite to that of the first constant voltage signal, a control terminal of the first output unit is the second control terminal of the output module, and an output terminal of the first output unit is connected to an output terminal node; and the first output unit is used to output the second constant voltage signal when the second node is at a valid level, wherein the second constant voltage signal has a same signal state as a first scan signal included in the scan signal and for controlling the data writing transistor to be turned off, wherein the output module further comprises a second output unit; an input terminal of the second output unit receives the second clock signal, a control terminal of the second output unit is the first control terminal of the output module, and an output terminal of the second output unit is connected to the output terminal node; and the second output unit is used to output the second clock signal when the second node is at an invalid level and the first node is at a valid level, wherein the second clock signal has a signal state corresponding to that of a second scan signal included in the scan signal and for controlling the data writing transistor to be turned on, wherein the first output unit comprises:

a third switch transistor, wherein a control electrode of the third switch transistor is the control terminal of the first output unit, a first electrode of the third switch transistor is the input terminal of the first output unit, and a second electrode of the third switch transistor is the output terminal of the first output unit; and a first capacitor, wherein a first terminal of the first capacitor is connected to the control electrode of the third switch transistor, and a second terminal of the first capacitor is connected to the first electrode of the third switch transistor;

wherein the second output unit comprises:

a fourth switch transistor, wherein a first electrode of the fourth switch transistor is the output terminal of the second output unit, and a second electrode of the fourth switch transistor is the input terminal of the second output unit;

a fifth switch transistor, wherein a first electrode of the fifth switch transistor is connected to a control electrode of the fourth switch transistor, a control electrode of the fifth switch transistor receives the first constant voltage signal, and a second electrode of the fifth switch transistor is the control terminal of the second output unit; and a second capacitor, wherein a first terminal of the second capacitor is connected to the control electrode of the fourth switch transistor, and a second terminal of the second capacitor is connected to the first electrode of the fourth switch transistor.

2. The driving circuit according to claim 1, wherein the voltage stabilization module comprises a first switch transistor and a second switch transistor;

a control electrode of the first switch transistor is the first control terminal of the voltage stabilization module, a first electrode of the first switch transistor is the input terminal of the voltage stabilization module, and a second electrode of the first switch transistor is connected to a first electrode of the second switch transistor; and a control electrode of the second switch transistor is the second control terminal of the voltage stabilization module, and a second electrode of the second switch transistor is the output terminal of the voltage stabilization module.

3. The driving circuit according to claim 1, wherein the voltage stabilization module comprises a first switch transistor and a second switch transistor;

a control electrode of the first switch transistor is the second control terminal of the voltage stabilization module, a first electrode of the first switch transistor is the input terminal of the voltage stabilization module, and a second electrode of the first switch transistor is connected to a first electrode of the second switch transistor; and a control electrode of the second switch transistor is the first control terminal of the voltage stabilization module, and a second electrode of the second switch transistor is the output terminal of the voltage stabilization module.

4. The driving circuit according to claim 2, wherein each of the first switch transistor and the second switch transistor is a P-type transistor.

5. The driving circuit according to claim 1, wherein each of the third switch transistor, the fourth switch transistor and the fifth switch transistor is a P-type transistor.

6. The driving circuit according to claim 1, wherein the control module comprises:

a sixth switch transistor, wherein a control electrode of the sixth switch transistor is the control terminal of the control module, a first electrode of the sixth switch transistor is the input terminal of the control module, and a second electrode of the sixth switch transistor is the output terminal of the control module.

7. The driving circuit according to claim 6, wherein the input module comprises a seventh switch transistor and an eighth switch transistor;

a control terminal of the seventh switch transistor receives the first clock signal, a first electrode of the seventh switch transistor is the first input terminal of the input module, and a second electrode of the seventh switch transistor is connected to the first node; and a control terminal of the eighth switch transistor receives the first clock signal, a first electrode of the eighth switch transistor is the second input terminal of the input module, and a second electrode of the eighth switch transistor is connected to the second node.

8. The driving circuit according to claim 7, wherein each of the sixth switch transistor, the seventh switch transistor and the eighth switch transistor is a P-type transistor.

9. The driving circuit according to claim 1, wherein the driving circuit comprises a plurality of cascaded driving circuits.

10. A display panel comprising the driving circuit according to claim 1.

11. A display apparatus comprising the display panel according to claim 10.

12. A voltage stabilization control method used by the driving circuit according to claim 1, comprising:

providing, by the voltage stabilization module, a voltage stabilization signal to the first node when the second node is at a valid level and the second clock signal is at a valid level, wherein the voltage stabilization signal is the scan signal.

* * * * *